US005291759A

United States Patent [19]

Dokoupil

[11] Patent Number: 5,291,759

[45] Date of Patent: Mar. 8, 1994

[54] PROCESS AND EQUIPMENT FOR STRETCHING OF LEATHER

[76] Inventor: Jiri Dokoupil, Hochstrasse 9, Guckingen, Fed. Rep. of Germany, 6251

[21] Appl. No.: 61,280

[22] PCT Filed: Aug. 25, 1989

[86] PCT No.: PCT/EP89/00998

§ 371 Date: Feb. 26, 1991

§ 102(e) Date: Feb. 26, 1991

[87] PCT Pub. No.: WO90/03448

PCT Pub. Date: Apr. 5, 1990

Related U.S. Application Data

[63] Continuation of Ser. No. 655,441, Feb. 26, 1991, abandoned.

[30] Foreign Application Priority Data

Sep. 29, 1988 [DE] Fed. Rep. of Germany ..... 3833068

[51] Int. Cl.[5] ..... C14B 1/26

[52] U.S. Cl. ..... 69/19.1; 69/21

[58] Field of Search ..... 69/48, 46, 33, 21, 19.1, 69/19, 8, 1.5; 38/70, 102, 143

[56] References Cited

U.S. PATENT DOCUMENTS

| | | | |
|---|---|---|---|
| 3,727,437 | 4/1973 | Dokoupil | 69/48 |
| 3,872,695 | 3/1975 | Busek | 69/48 |

FOREIGN PATENT DOCUMENTS

| | | | |
|---|---|---|---|
| 0036183 | 9/1981 | European Pat. Off. . | |
| 510128 | 10/1930 | Fed. Rep. of Germany . | |
| 1296736 | 6/1969 | Fed. Rep. of Germany . | |
| 3010003 | 2/1986 | Fed. Rep. of Germany | 69/48 |
| 3431353 | 6/1986 | Fed. Rep. of Germany . | |
| 1407169 | 6/1965 | France . | |
| 2096351 | 1/1972 | France . | |
| 2602795 | 2/1988 | France | 69/19.1 |
| 393620 | 11/1965 | Switzerland . | |

*Primary Examiner*—Clifford D. Crowder
*Assistant Examiner*—Michael A. Neas
*Attorney, Agent, or Firm*—Lalos & Keegan

[57] ABSTRACT

A process for stretching leather and similar flat materials, characterized by at least one part of an initial surface of a piece of leather is placed on a bearing surface which is slidable with respect to the leather, the piece of leather being loaded with pressure forces, which are spread over at least one part of the bearing surface, working in the direction of the bearing surface, and the stretching forces for stretching the leather under strain relative to the bearing surface are put into effect over at least one part of a second surface of the piece of leather and being at least approximately tangential with reference to a leather surface as well as at least approximately polydirectional in the direction of the edge of the leather piece.

22 Claims, 2 Drawing Sheets

PROCESS AND EQUIPMENT FOR STRETCHING OF LEATHER

This is a continuation of copending application(s) Ser. No. 07/655,441 filed on Feb. 26, 1991, now abandoned.

The invention refers to a process for stretching leather and similar flat materials, such as e.g. skins, furs, but also in certain cases sheet blanks and similar.

From the DE-OS 30 10 003 it is known that pieces of leather—usually referred to as "skins" for short, are clamped in a gap between two elastically extendable membranes pressed against each other through negative pressure and sealed against each other along the length of their perimeters and that the stretching process is executed by simultaneous stretching of the two membranes with frictionally engaged conveyance of the membrane clamped between them. In this way, an evenly distributed and permanent surface enlargement of considerable extent and which is free of folds is achieved over the surface of the leather. Required also for each of the two membranes is a stretching device whose effects are spread over the perimeter of the membranes. A more or less equal stretching of the membranes must be ensured because of the friction contact between the two membranes and the leather.

Task of the invention is the creation of a stretching process in contrast to this which enables the same quality stretching result to be achieved without the comparably time-consuming stretch loading of both leather surfaces. The solution provided by the invention to this task is determined by the combination of the following features.

a) at least one part of the initial surface of a piece of leather is mounted on a bearing surface which is particularly smooth with regard to the leather;

b) the piece of leather is loaded with the pressure forces spread over at least one part of the bearing surface which work against the bearing surface.

c) stretching forces, which are at least approximately tangential with reference to a leather surface as well as at least approximately polydirectional in the direction of the edge of the leather piece, are put into effect to stretch the leather at a strain relative to the bearing surface on at least one part of the second surface of the piece of leather.

As a result of the detailed examinations, it has been proved that excellent results can be achieved with regard to extent and similarity of form of the surface enlargement using this type of single-sided surface loading of the leather.

This is generally dependent on the essentially even simultaneous and polydirectional straining of the leather relative to the bearing surface. The required smooth sliding of the bearing surface can generally be assured without difficulty by taking into account the properties (in particular the moisture content) of the leather in each case in selection of the usual trade materials. Surprisingly, it has been shown that the pressure forces can also be produced by loading the leather with negative pressure (with reference to the ambient atmosphere). This negative pressure is used to advantage in a gap in which the leather is enclosed.

In addition to this, the invention provides other possibilities for carrying out other functions for processing the leather connected with the stretching process. This includes firstly the combination of a stretching process with heating which can also be used to improve the stretching results. In this case, the invention also includes the combination of the stretching process with drying. Surprisingly it has been shown that multiple treatment can be carried out without encountering fundamental problems. This is a significant step towards rationalization when considering the great importance of the setting of certain humidity values during leather production and leather processing.

In practice, it has proved advantageous to load the second surface of the leather with suction negative pressure during the stretching process.

A further task set for the invention is the creation of a stretching device for leather and similar, which is particularly suited to execution of the process according to the invention. The solution to this task is determined by the following characteristics.

a) provision of a bearing appliance for retaining the spread leather with a slidable bearing surface for the initial leather surface b) provision of a stretching appliance with at least one of the pressure or stretch tools gripping the leather arranged opposite the bearing surface.

A stretching device of this type distinguishes itself in comparison to the familiar types by its beneficial simplified design and reduced construction time as well as by its increased stability and operating safety. A further advantage is also the slidability of the bearing surface gained with the aid of an assembly or a coating with synthetic material which has a self-lubricating surface property, e.g. tetrafluorethylene.

A further requirement of the invention was the creation of a combined stretching and heat treatment device for flat materials such as leather and similar. The solution of the invention to this task, assuming a stretching facility of the type mentioned, is by providing a heating device which works in combination with the leather being processed. This not only allows a rational solution to combined treatment tasks in one machine while saving handling and work sequences but also especially improves in some cases permanent stretching of the leather. A treatment device of this type should preferably be designed so that the bearing element which forms the bearing surface is at least partly made of a heat conducting material, preferably metal, which works in combination with a conduction or convection heating appliance.

A particularly important task of the invention was also aimed at a combination of different processing functions, i.e. a combination of stretching and drying. The appropriate solution has been found by forming a gap between the bearing surface and the stretching tool which receives the piece of leather and which is connected to a suction device. Generally, it is advisable to equip this version with the already mentioned characteristics of a heating device.

BRIEF DESCRIPTION OF THE DRAWINGS

Further characteristics and advantages of the invention are explained with reference to the design types shown as examples in the drawings. They show:

FIG. 3, however with modified formation of the stretching tool and the bearing element FIG. 5 another part vertical section acc. FIG. 3 for a membrane stretching tool provided with a special structure of working surface FIG. 6 a complete side view of a stretching-drying machine with modified bearing appliance.

Detailed Description

Figure 1:
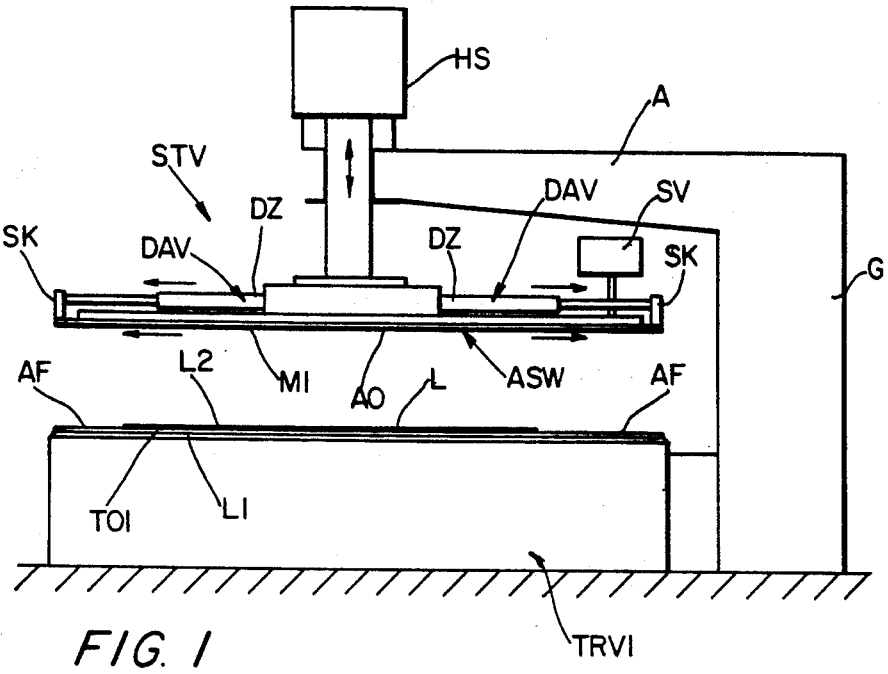
FIG. 1 a complete side view of a leather stretching machine according to this invention FIG. 2 an illustration of the principle of the stretching function according to this invention.

In the case of the stretching machine of FIG. 1, a stretching device STV, formed completely like a plate and arranged longitudinally on the horizontal plane, is supported with vertical adjustment on cantilever A of a stationary machine frame G. An elevating and lowering device HS shown for reasons of simplicity as a piston cylinder arrangement allows adjustment of the stretching device between the raised home position shown in FIG. 1 and a lowered operating position.

Figure 2:
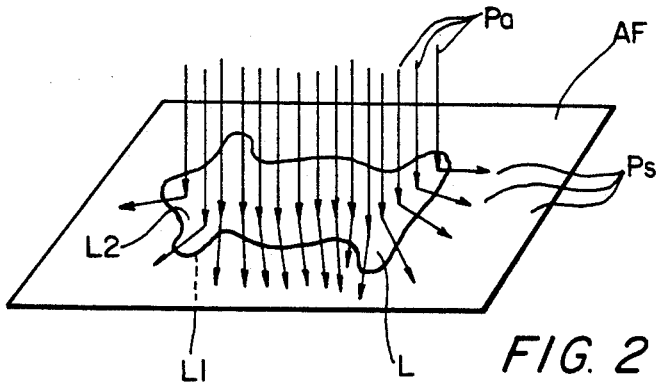

A piece of leather L (shortened to "skin" in the following) is spread without folds with its initial (facing downwards) surface L1 over the highly slidable bearing surface AF of a bearing appliance TRV1. In the lowered operating position of the stretching device STV, the working surface facing downwards A0 of a pressing and stretching tool ASW moves into contact with the second (upwards facing) surface L2 of the skin. As shown in a simplified version in FIG. 2, the latter is loaded firstly with evenly formed and spread pressure forces Pa working against the bearing surface AF and then with stretching forces Ps, more or less tangential with reference to the leather surface as well as polydirectional directed towards the edge of the skin, to stretch the skin using straining relative to the bearing surface.

An essential part of the pressing and stretching tool ASW is the membrane M1, which covers the skin and can be stretched elastically, which is stretched to its perimeter line in the usual direction using extending drive unit DAV while maintaining the pressure forces Pa and at the same time producing the tangential stretching forces Ps by friction contact. The extending drive unit DAV incorporates a number of piston cylinder units DZ, arranged parallel to the membrane plane and distributed over the perimeter of the membrane, whose piston rods are fixed to the edge of the membrane with rod heads SK. An arrangement of this type is familiar from DE-OS 30 10 003 and, therefore, requires no further illustration or explanation.

The pressure forces Pa, also familiar from the DE-OS mentioned, are produced using negative pressure in the gap SP containing the skin. This gap is formed between the bearing surface AF at one side and the working surface AO of the membrane M1 on the other side. To seal the gap, a bulgy soft seal DR is provided running the length of the perimeter of the membrane M1 without interruption which lies closely on and seals the bearing surface AF. These conditions can be seen individually in FIG. 3.

An essential difference to the familiar arrangement is, however, that the low-positioned stretching device with its own membrane and related extending drive unit is no longer required. This advantageous simplification results from the use of slidable bearing surface AF in the area of the low-positioned bearing appliance.

An essential difference to the familiar arrangement is, however, that the low-positioned stretching device with its own membrane and related extending drive unit is no longer required. This advantageous simplification results from the use of a highly slidable leather carrier.

Figure 3:
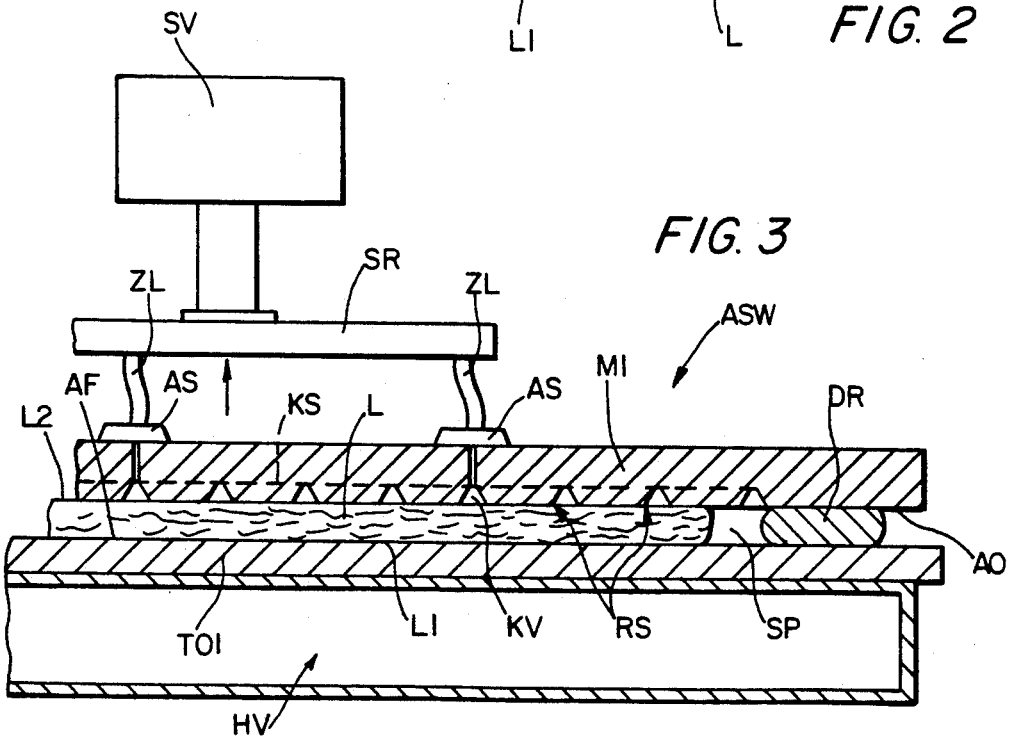
FIG. 3 a part vertical section at the edge area of a membrane stretching tool with suction device and a bearing element with heating device, inside a larger-scale stretching-drying machine FIG. 4 a part vertical section acc.

In addition to this, the use of a rigid support, which does not, however, have any detrimental effects on the stretching process of the leather, makes it possible in a particularly simple way to make the machine into a combined stretching and heat treatment device. For this purpose, a conduction heating device HV as shown in FIG. 3 is arranged on the underside of the bearing element TO1, e.g. in the way shown as a cored panel filled with a circulating heating medium which is connected to the bearing element in a way which allows good heat conduction. The bearing organ itself is also made of heat conducting material. The choice of material for this is facilitated greatly by the rigid property of the bearing element or even made possible as a result of this, because on the one hand suitable heat conducting values and heat transfer values are available in the area of the rigid materials (in contrast to the soft, flexible materials required for a membrane) and there is no need to consider its stretching properties. Overall, an intensive thermally effective link between the heating device and the leather can be achieved.

Instead of or in combination with the conduction heating indicated in the example, convection heating can also be used if necessary. For this purpose, a gaseous heating medium is made to circulate within the gap in which the leather is contained. It is always possible to equip the bearing appliance or the bearing element with a radiant heating system which acts upon the leather.

A further innovative step leads, as also shown in FIG. 3, to the stretching-drying device. In this case, the gap SP is connected to a suction device SV which allows rapid withdrawal of the evaporating leather moisture. The connection between the suction device SV and the gap SP is made by means of a header SR with a number of flexible, tubular branch pipes ZL and through the relevant connections AS and a duct system KS to the membrane M1. This duct system is formed as an open relief structure RS with a flat network (shown here as a cross-section) of groove-type cavities KV in the area of the working surface AO of the membrane, as shown in the example of FIG. 3. This produces evenly distributed suction effect and vapour withdrawal.

Figure 4:
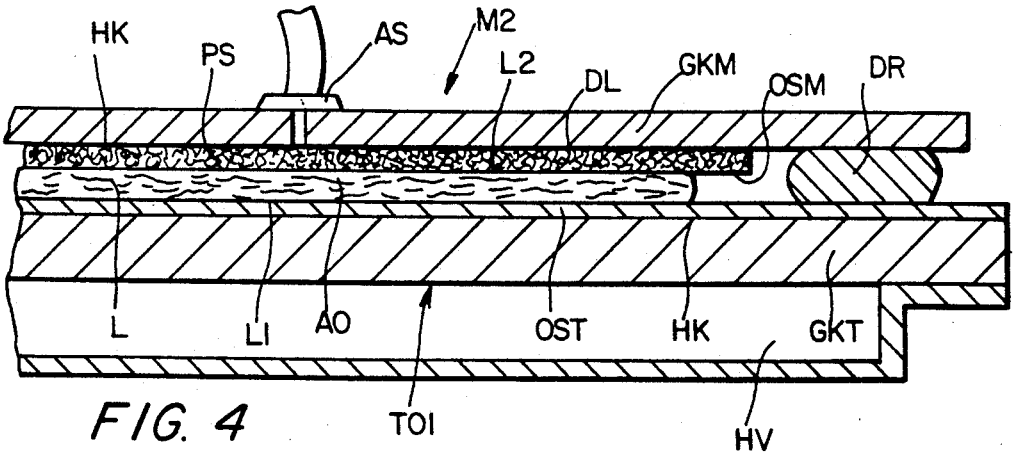

In the case of FIG. 4, the bearing element TO1 is provided with a surface layer OST of a very slidable material with reference to the leather which forms the bearing surface AF. This makes optimal combination of the heat conductivity of the bearing element with the slidability of the bearing surface, where the thickness of the surface layer is kept very low. Preferably, the surface layer should consist of a very slidable synthetic material, in particular tetrafluorethylene.

In the interests of high rigidity and resistance to wear, the surface layer can also be provided with a felt reinforcement. This benefits another essential part of the invention according to which the bearing element TO1 exhibits a backing material GKT which is connected to the surface layer OST and is removable. This allows simple replacement for wear. A contact adhesive layer is provided for the type in FIG. 4 with removable connection of the surface layer OSM.

Figure 5:
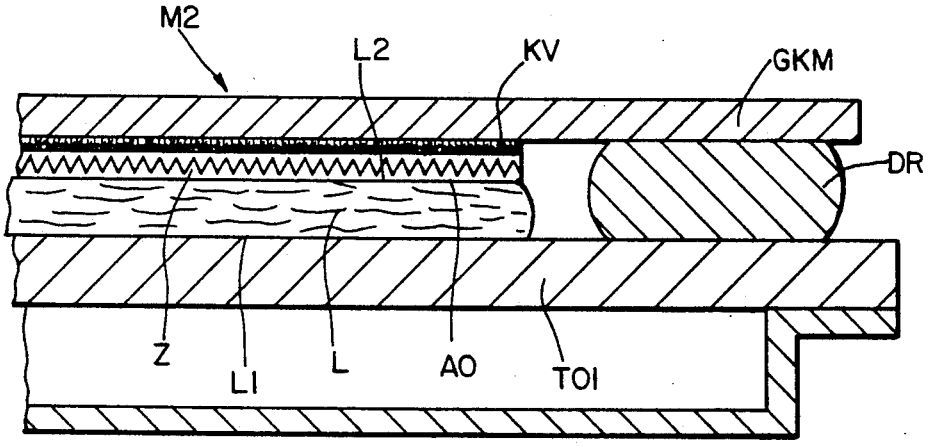

Also in the case of the type in FIG. 4, a poreous membrane M2 is provided with connection to a suction device similar to that of FIG. 3. The membrane has a pore structure PS on its bearing surface AO which is open and poreous in the direction of the leather surface and which is linked to a suction device through pores DL and connections AS. The pore structure is also contained in an elastically extendable membrane surface layer OSM which is removably connected to a membrane backing material GKM by means of a contact adhesive layer HK. Sometimes a VELCRO (hook and loop fastener) fastening arrangement KV is used instead, as shown without poreous membrane structure and suction device in FIG. 5 as an example, for the removable fixing of a surface layer with toothed-type structure Z in the area of the membrane working surface AO. A surface structure of this type permits a positive transfer of stretching forces to the leather and, therefore, a particularly intensive stretching effect.

Figure 6:
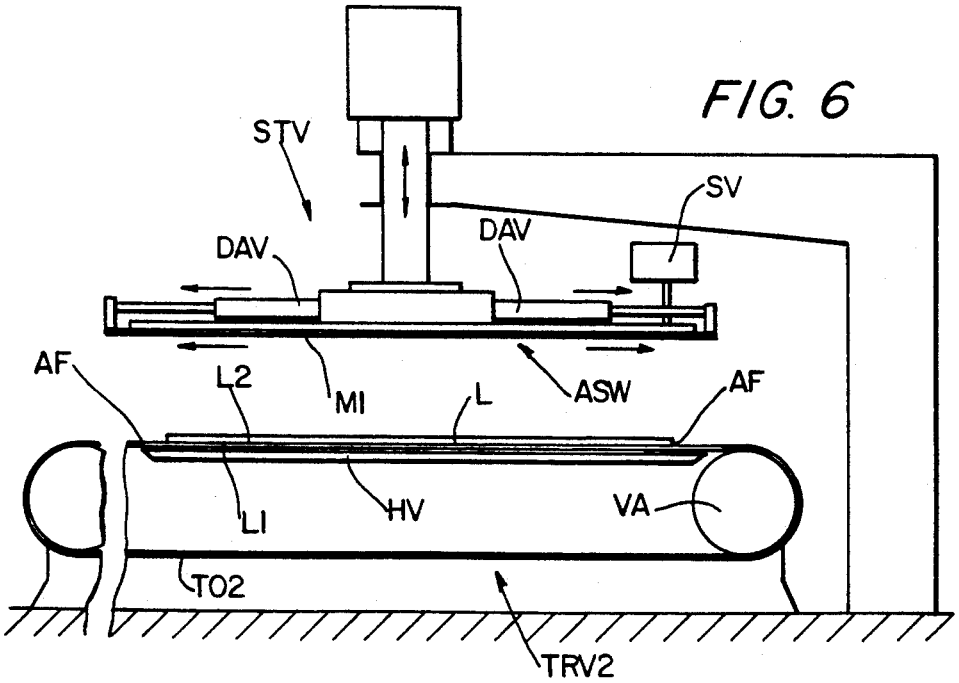

FIG. 6 shows a variation of the stretching-drying machine according to this invention with a bearing appliance TRV 2 which exhibits a band-type, freely-supported bearing element TO2 linked to feeding drive unit VA in a direction parallel to the bearing surface with reference to the pressing and stretching tools ASW. The bearing appliance and, therefore, the bearing surface are in this case, as shown at one side in the example, enlarged beyond the outline of the stretching device STV. This allows the mounting of skin in a freely accessible area next to the stretching appliance also during the processing of another skin in addition to the final rapid removal of the skin mounted in working area. This signifies a considerable step towards rationalization.

I claim:

1. Process for stretching leather and similar flat materials, characterized by the following steps:

a) placing an initial surface (L1) of a piece of leather (L) at least partly on a bearing surface (AF) that is substantially stationary during leather stretching so as to slidably support the leather;

b) loading the piece of leather with pressure forces (Pa) spread over the bearing surface and acting in a direction towards said bearing surface;

c) stretching the leather while slidably supported on said substantially stationary bearing surface by means of stretching forces (Ps), said stretching forces being put into effect at least partly over a second surface (L2) of the piece of leather and acting at least approximately tangential to said second surface (L2);

d) said stretching forces (Ps) further acting at least approximately polydirectionally and distributed over the perimeter of the piece of leather towards the outer margin thereof;

e) said bearing surface (AF) being substantially stationary during stretching of the leather and slidable relative to the leather so as not to participate in said stretching.

2. Process according to claim 1, wherein said pressure forces (Pa) working on the leather are produced by loading the leather with negative pressure with reference to the ambient atmosphere.

3. Process according to claim 2, wherein said negative pressure is produced in a gap (SP) surrounding the leather.

4. Process according to claim 2 or 3 including drying the leather during said stretching.

5. Process according to claim 4, including heating the leather during said stretching and loading its second surface with suction forces due to said negative pressure.

6. Facility for stretching leather and similar flat materials in a process including the steps of placing a piece of leather at least partly into a stretching device, loading the piece of leather with pressure forces spread over the leather piece, stretching the leather by means of stretching forces, said stretching forces acting at least approximately tangential to the leather as well as polydirectionally and distributedly over the perimeter of the piece of leather towards the outer margin thereof, said facility including:

a) a bearing appliance (TRV1, TRV2) for receiving the leather (L), said appliance including a bearing surface (AF) that is substantially stationary during leather stretching and which is slidable relative to an initial surface (L1) of the leather piece during stretching thereof;

b) a stretching device (STV) arranged opposite said bearing surface (AF) and including stretching means (ASW) acting on a second leather surface (L2) at least approximately tangentially thereto;

c) said stretching means (ASW) acting on said second leather surface (L2) polydirectionally and distributedly over the perimeter of the piece of leather towards the outer margin thereof;

d) said bearing surface (AF) during stretching of the leather being substantially stationary but slidable relative to the leather so as not to participate in said stretching.

7. Facility according to claim 6, wherein said stretching means (ASW) includes an elastically extendable membrane (M1, M2) and an extending drive unit (DAV) connected to said membrane.

8. Facility according to claim 7, wherein said membrane includes a relief structure in the area of a working surface (AO) which comes into contact with said second leather surface (L2), said relief structure including cavities (KV) which are at least partly continuously connected to each other, and said facility further including a suction device (SV).

9. Facility according to claim 7, wherein said membrane (M2) includes an open and poreous structure (PS), at least in the area of a working surface (AO) which comes into contact with said second leather surface (L2), said facility including a suction device (SV) connected to said poreous structure.

10. Facility according to claim 9 wherein said membrane includes a backing material (GKM) and an elastically extendable surface layer (OSM) linked to said backing material and wherein said poreous structure (PS) is formed in the surface layer (OSM).

11. Facility according to claim 10, wherein said surface layer (OSM) is removably connected to said backing material (GKM).

12. Facility according to claim 11, including a hook and loop fastener for connecting said surface layer (OSM) to the membrane backing material (GKM).

13. Facility according to claim 7 or 8, wherein said membrane includes a tooth-formed structure (Z) which positively grips leather during a stretching process.

14. Facility according to claims 6, 7 or 8, further including a heating device (HV) for heating the leather being processed.

15. Facility according to claim 14, including a bearing element (TO1, TO2) which forms the bearing surface (AF), said bearing element at least partly made of highly heat-conducting material and being located proximate to said heating device.

16. Facility according to claim 14, including a gap (SP) which accommodates the piece of leather (L)

formed between the bearing surface (AF) and the stretching means (ASW), and wherein said stretching tool (ASW) is connected to the suction device (SV).

17. Facility according to claim 15, wherein the bearing element (TO1) includes a surface layer (OST) which is made of highly slidable material with respect to the leather and which forms the bearing surface (AF).

18. Facility according to claim 17, wherein the surface layer (OST) of the bearing element (TO1) is made of a very slidable synthetic material, said synthetic material including tetrafluorethylene.

19. Facility according to claim 18, wherein the surface layer (OST) of the bearing element (TO1) includes a felt-reinforced synthetic material.

20. Facility according to claim 17 wherein the bearing element (TO1) includes a backing material (GKT) which can be disconnected from the surface layer (OST).

21. Facility according to claim 11, further including a contact adhesive layer provided for the removable connection of the surface layer (OSM).

22. Facility according to claims 7 or 8, wherein the bearing appliance (TRV2) includes a band-type freely-supported bearing element (TO2) connected to a feeding drive unit (VA).

* * * * *